United States Patent [19]

deVersterre et al.

[11] Patent Number: 4,484,285

[45] Date of Patent: Nov. 20, 1984

[54] LOAD-TRANSFER MECHANISM

[75] Inventors: William I. deVersterre, Warren; Donald A. Worden, Pompton Plains, both of N.J.

[73] Assignee: Marotta Scientific Controls, Inc., Boonton, N.J.

[21] Appl. No.: 597,263

[22] Filed: Apr. 6, 1984

Related U.S. Application Data

[60] Continuation of Ser. No. 548,619, Nov. 4, 1983, abandoned, which is a division of Ser. No. 347,687, Feb. 11, 1982, abandoned.

[51] Int. Cl.[3] ..... G06F 15/46; B21B 37/08; B21B 31/32

[52] U.S. Cl. ..... 364/472; 72/21

[58] Field of Search ..... 364/469, 472, 558, 153; 72/16, 19, 21, 237, 244, 245, 246, 248; 91/459

[56] References Cited

U.S. PATENT DOCUMENTS

| | | | |
|---|---|---|---|
| 4,102,171 | 7/1978 | Petry et al. | 72/245 |
| 4,335,435 | 6/1982 | Miura | 364/472 X |
| 4,379,395 | 4/1983 | Konishi et al. | 364/472 X |

*Primary Examiner*—Joseph F. Ruggiero

*Attorney, Agent, or Firm*—Hopgood, Calimafde, Kalil, Blaustein & Judlowe

[57] ABSTRACT

The invention contemplates a prestressed rolling mill incorporating a system of hydraulically operated load-transfer blocks, wherein the blocks are of unitary construction and bodily interposed between vertically opposed regions of upper and lower back-up roll chocks, at the respective inlet and exit sides of each axial end of the mill. Each load-transfer block is inherently self-adapting (at each of a plurality of force-application regions) to such small locally different deformations in the mill frame as result from the block's modulating contribution to net prestressing force; further, each load-transfer block includes its own hydraulic-control system with minimum-displacement actuators whereby a fast time constant of hydraulic response is achieved. Still further, control of all load-transfer blocks is monitored and coordinated through a microprocessor having instantaneous hydraulic-pressure and positional data inputs electrically supplied from all load-transfer blocks, as well as from various other data inputs pertaining to mill operation.

40 Claims, 12 Drawing Figures

LOAD-TRANSFER MECHANISM

BACKGROUND OF THE INVENTION

This application is a continuation of copending application Ser. No. 548,619, filed Nov. 4, 1983, abandoned and said copending application is a division of originally filed application Ser. No. 347,687, filed Feb. 11, 1982; said originally filed application is now abandoned but is survived by copending application Ser. No. 562,865, filed Dec. 19, 1983.

The invention relates to rolling machines, as for the cold-rolling of metal, such as aluminum, to produce an elongate sheet of predetermined thickness, which may be a foil thickness.

In such machines, squeeze forces are in the order of hundreds of tons applied at a working pass via working rolls under compressional loading of back-up rolls, the ends of which are journaled for rotation in individual chocks. Massive frame or housing structure contains and mounts the chocks and their rolls, and the frame structure also fully contains all compressional forces delivered to the back-up rolls via their chocks. However, despite its massive nature, the frame yields elastically to the large forces involved, thus placing limitations on the fidelity with which thickness tolerances can be maintained on rolled product, particularly near the beginning or near the end of a given product run; moreover, elastic deformations of the frame impair the ability of chock-loading systems to respond to such transient changes in load as may be called for by sensed thickness, hardness, or width variations in input material, or by roll eccentricity, in the course of a given run. The chock-loading systems generally involve either motor-driven lead screws or hydraulic actuators, each of which is inherently a limiting factor on ability to respond quickly to transient load requirements.

In recognition of problems attributable to elastic deformation of the frame, it has been a practice to prestress the mill by electromagnetically setting the working-roll gap through a wedge assembly installed between roll chocks. The mill frame is placed under a constant pre-stress force which substantially exceeds the maximum rolling force, and this pre-stress force counteracts the rolling force to eliminate further housing stretch or deflection. The wedges are in paired opposition, and differentially actuated by motor-driven lead screws.

In another approach to the problem, U.S. Pat. No. 4,102,171 discloses load-transfer blocks between opposed chocks at each end of the mill, to relieve a part of the pre-stress force for each particular strip-rolling operation. At each load-transfer block, a combination of hydraulic pressure and gas pressure provides a controlled substantially unyielding force during a rolling operation, and a yielding shock absorber for preventing full prestress load from coming on the rolls when an end of the strip passes the rolls or when a strip breaks.

In the commercial manufacture of aluminum foil, from input aluminum sheet material, involving 50 percent thickness reduction at each rolling stage, it is customary to manufacture to an ultimate product-thickness tolerance of 5 percent. However, existing prestressing techniques do not assure that this tolerance requirement will necessarily be met, even though the system be finely adjusted for a 2.5 percent thickness tolerance, so as to have a 2:1 safety factor in respect of the specified 5 percent tolerance. The time constants of prestress control are not equal to the task of responding to roll eccentricity, varying thickness and hardness of input sheet material, at the increasing rate of rolling speed which competition compels, and to the more severe thickness tolerances which economics dictate.

BRIEF STATEMENT OF THE INVENTION

It is an object of the invention to provide an improved technique and means for modifying prestressing force in a rolling mill of the character indicated.

It is a specific object to achieve the above object with a shorter response-time constant and greater precision than heretofore.

Another specific object is to provide a prestress-modulating system for such a mill whereby thickness tolerances less than 2.5 percent may be reliably met, for input sheet material of average quality, e.g., characterized by hardness fluctuations.

A further specific object is to meet the above objects with a prestress-modulating system which is inherently self-adapting to such variations in elastic deformation.as may be locally involved in the mill frame.

A still further object is to provide a system of the character indicated such that it may be installed as an upgrading component of existing rolling mills.

The invention achieves these objects and certain further features in a system of purely hydraulically operated load-transfer blocks adapted for bodily inserted application between vertically opposed regions of upper and lower back-up roll chocks, at the respective inlet and exit sides of each end of the mill. Each load-transfer block is inherently self-adapting (at each of a plurality of force-application regions) to such small locally different deformations in the frame or chocks as result from its modulating contribution to net prestressing force; further, each load-transfer block includes its own hydraulic-control system with minimum-displacement actuators whereby a fast time constant of hydraulic response is achieved. Still further, control of all load-transfer blocks is monitored and coordinated through a microprocessor having instantaneous hydraulic-pressure and positional data inputs electrically supplied from all load-transfer blocks, as well as from various other data inputs pertaining to mill operation.

DETAILED DESCRIPTION

The invention will be described in detail in conjunction with the accompanying drawings, in which.

Figure 1:
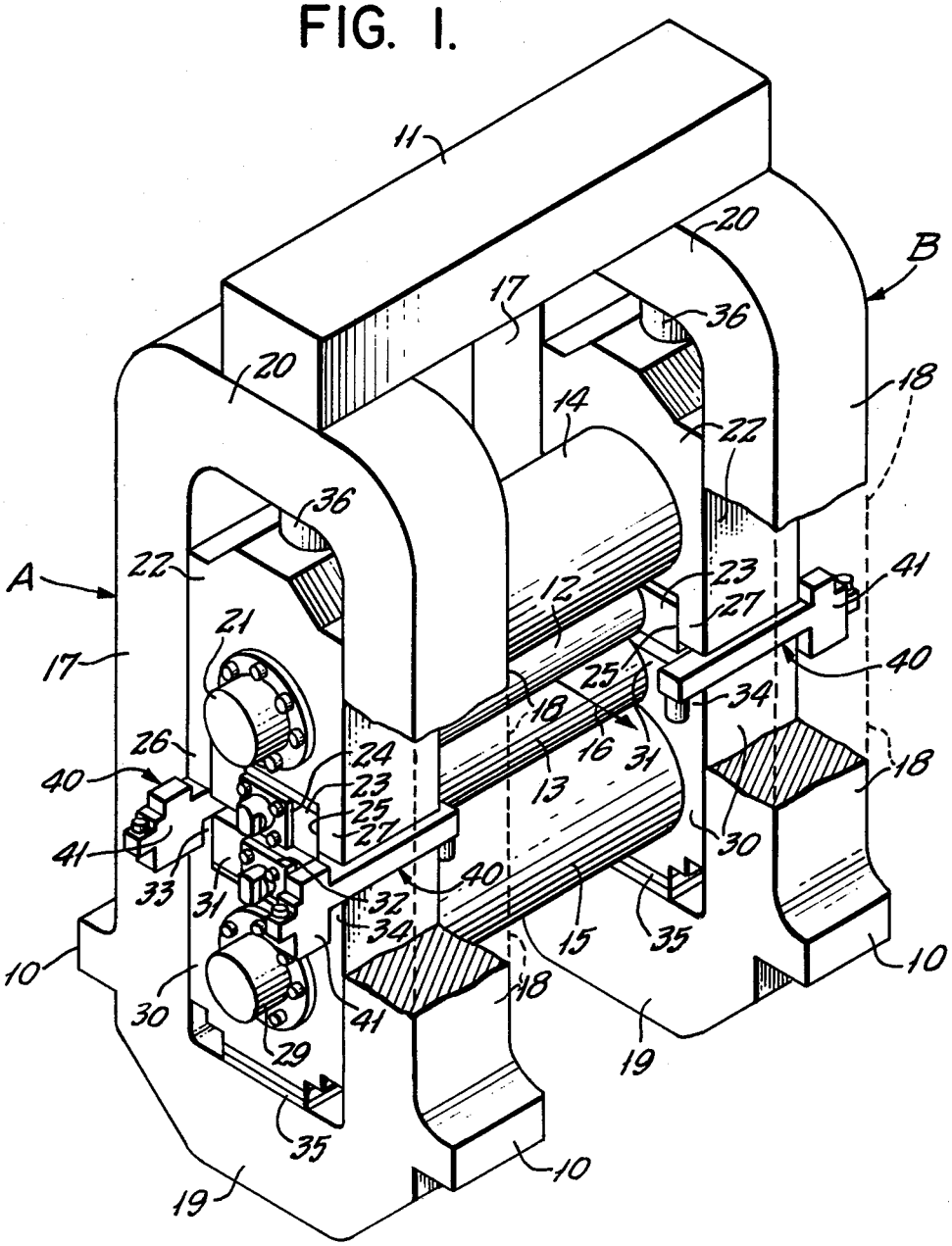
FIG. 1 is a simplified isometric view of a prestressed rolling mill incorporating a load-transfer system of the invention, certain parts being locally broken-away, to reveal internal relationships.

Referring initially to FIG. 1, a rolling mill is shown wherein the frame comprises like upstanding housings A–B, with mounting feet 10 adapted for secure anchorage to suitably bedded support (not shown) as at ground-floor level. An upper cross tie 11 secures upper ends of the housings A–B to each other. Housings A–B provide suspension for the respective ends of upper and lower working rolls 12–13 and their associated upper and lower back-up rolls 14–15, the back-up rolls being driven (by means not shown) to accommodate continuous horizontal movement of inlet sheet material through a sheet-reducing pass between working rolls 12–13, for delivery of reduced strip between housings A–B and on the exit side of the mill, as suggested by a directional arrow 16. Each housing comprises like upstanding massive columns 17–18 on the inlet and exit sides of rolls 12 to 15 and integrally connected by lower and upper bridge formations 19–20; for the described location of feet 10, the respective lower bridge formations will be understood to be below grade, as within the same or spaced floor pits (not shown).

Each end of the upper back-up roll 14 is suitably journaled for rotation in bearing means at 21 within an upper back-up roll chock 22 which is vertically guided in ways defined by and between columns 17–18 of the particular housing; correspondingly, an upper working-roll chock 23 at each end of upper working roll 12 carries bearing means 24 for roll 12 and is in turn vertically guided in ways 25 defined by and between downward projections 26–27 forming part of the involved back-up roll chock 22. In similar fashion, each end of the lower back-up roll 15 is suitably journaled for rotation in bearing means at 29 within a lower back-up roll chock 30 which is vertically guided at the lower end of the same ways as described for the upper back-up roll chock 22; correspondingly, a lower working-roll chock 31 at each end of lower working roll 13 carries bearing means 32 for roll 13 and is in turn vertically guided in ways defined by and between upward projections 33–34 forming part of the involved back-up roll chock 30. As shown, the lower back-up roll chock 30 receives firm support at desired elevation, dependent upon the set-up of inserted shims 35 between chock 30 and the nearby bridge 19. Also as shown, the designation 36 will be understood to schematically apply to prestressing means which acts to load each end of the upper back-up roll 22; in a normal rolling operation, with a sheet of working material being reduced in its movement through the working pass between rolls 12–13, the prestressing force thus applied (by motor-driven screw or by hydraulic actuation at 36) will be understood to be so elevated as to elastically deform or stretch each of the housings A–B, in that all prestressing forces are contained within the respective housings. Both types of prestress development are mentioned, since the invention is applicable to older machines which incorporate motor-driven screws for the purpose, as well as to the more recently emergent hydraulically actuated variety; however, in a newly constructed machine incorporating the invention, hydraulic actuation is preferred, in which case the hydraulic actuation is applied (in place of shims 35) between lower bridge 19 and lower back-up chock 30, while (in place of screw actuation at 36) the upper chock 22 is directly referenced, as via shims, to the upper bridge 20.

The invention is concerned with load-transfer blocks 40, which may be duplicates of each other, at each of four locations in a mill as described in FIG. 1, the locations involving in each case the interposition of a block 40 between corresponding pairs of vertically opposed projections 26–33 (27–34) of adjacent back-up roll chocks. Each of these blocks 40 incorporates hydraulic mechanism for generating strong spreading force in opposition to the prestressing forces, and electrically operated hydraulic control means 41 for each load-transfer block is an immediately adjacent component of the involved hydraulic mechanism, with each control means 41 being laterally exposed (i.e., to the sides of housings A–B) for flexible remote connection to a microprocessor, and to supply and return lines of high-pressure hydraulic circuitry. Details of one of the load-transfer blocks will be described in connection with FIGS. 2 to 4.

Figure 2:
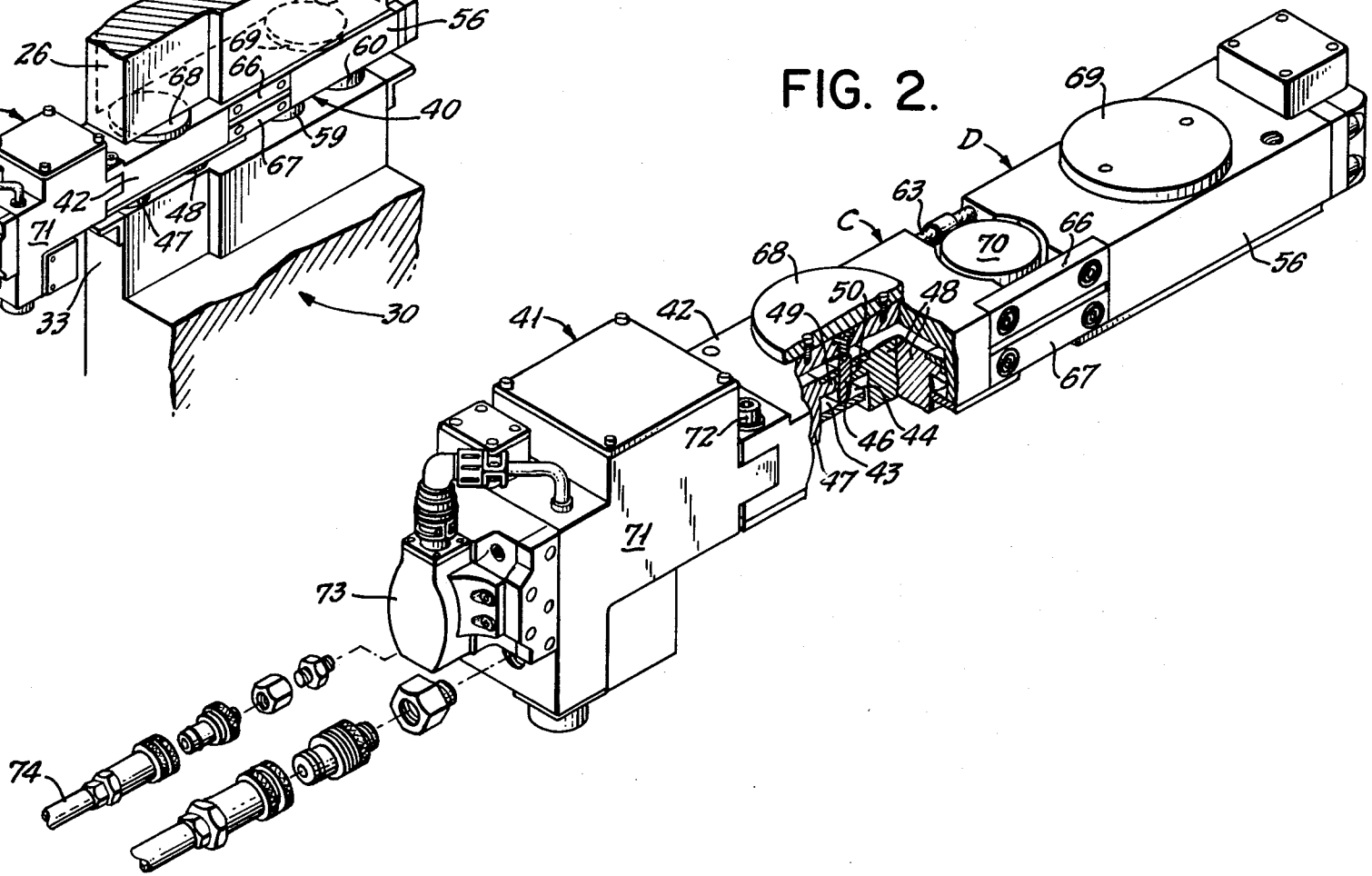
FIG. 2 is an enlarged view in perspective of a preferred embodiment of load-transfer block of the invention, being one of four incorporated in the mill of FIG. 1.
Figure 3:
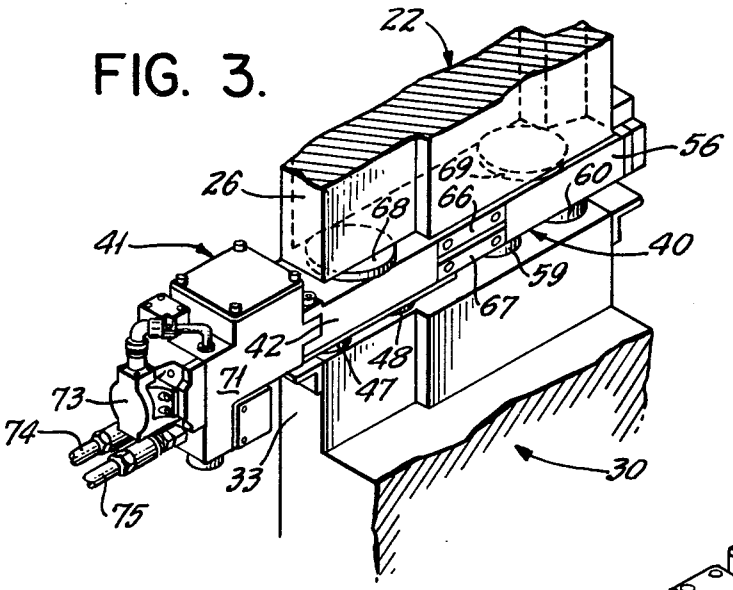
FIG. 3 is a fragmentary view similar to FIG. 2, to illustrate regions of force application to structure in the mill of FIG. 1.
Figure 4:
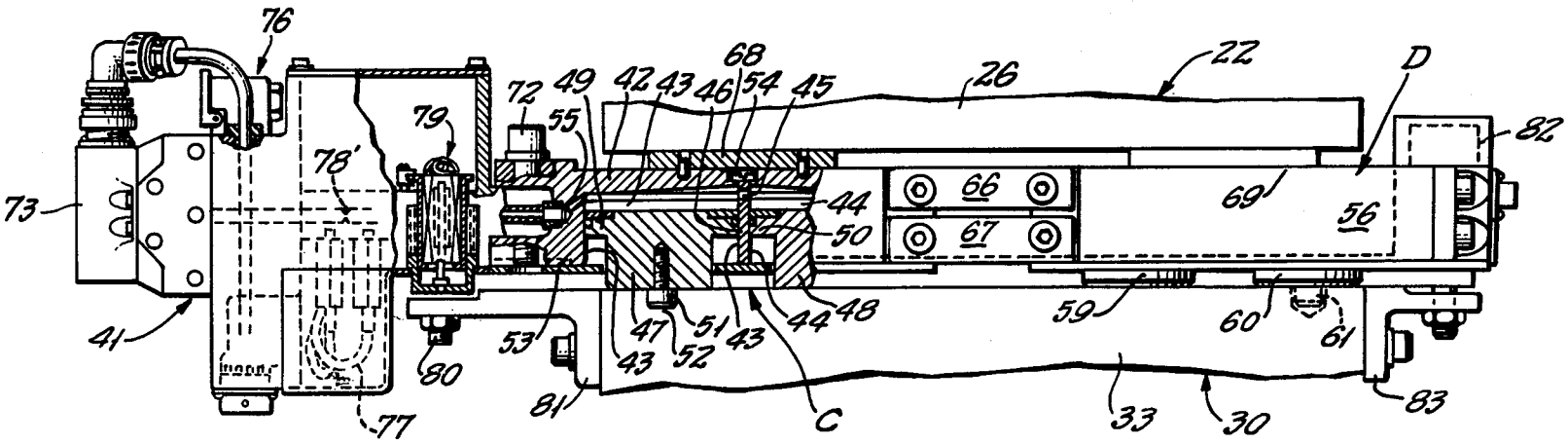
FIG. 4 is a view in front elevation of the load-transfer block of FIG. 2, the view being partly broken-away and in vertical section, to reveal internal detail.

As best seen in FIG. 2, each load-transfer block comprises a unit-handling assembly of three major components: two dual-cylinder units C–D and their associated control unit 41. The cylinder unit C has essentially a rectangular-prismatic body 42 with two like closely spaced bores 43–44 which are open to the downward side of the body and which laterally communicate with each other via an opening 45 (FIG. 4) at the head end of the relatively thin body wall 46 by which cylinder bores 43–44 are separated. First and second pistons 47–48 in the respective bores 43–44 have axially short head ends 49–50 which are radially enlarged for peripherally sealed fit to the associated cylinder wall. Preferably, the seal for each piston head 49(50) is at the axially central radial plane thereof, and the outer contour of each piston head is spherical, about the center of said radial plane; it will be understood that with such a seal and contour, each piston 47(48) has freedom to adapt within a range of axis misalignment, in terms of the axis of its associated cylinder bore 43(44). The lower end of each piston is of substantial cross-section and projects to a short extent below the bottom of body 42, for direct abutting relation with the flat upper surface of projection 33 of the lower back-up roll chock 30. For locating purposes, a bolt head 51 (FIG. 4) at the center of the bottom surface of piston 47 engages in a short bore 52 in the upper surface of chock projection 33. A bottom-closure plate 53 secured to body 42 is apertured to accommodate the projecting lower ends of pistons 47–48, and these apertures are seen in FIG. 4 to provide a circumferential clearance with each piston, to enable a degree of the indicated piston-misalignment adaptability.

For air-venting purposes, each of the cylinders is dome-shaped at its upper end, and the upper or head side of body 42 has a tapped air-bleed hole at the midpoint of the line of centers between cylinder bores 43–44, with a sloped-channel communicating with the central crest of each of the domed cylinder surfaces. The depth and bore of this hole are sufficient to establish the above-described opening 45 between head ends of the respective cylinders, and the stem of a closure plug 54 fitted to this tapped hole is short of the full depth of the hole, to assure that opening 45 will not be closed, when plug 54 is set to tightly seal a void-free filling of hydraulic fluid against loss. A port 55 for admission and exhaust of pressure fluid to the head end of cylinder 43 is therefore also the inlet-exhaust for pressure fluid flow to the head end of cylinder 44.

Figure 5:
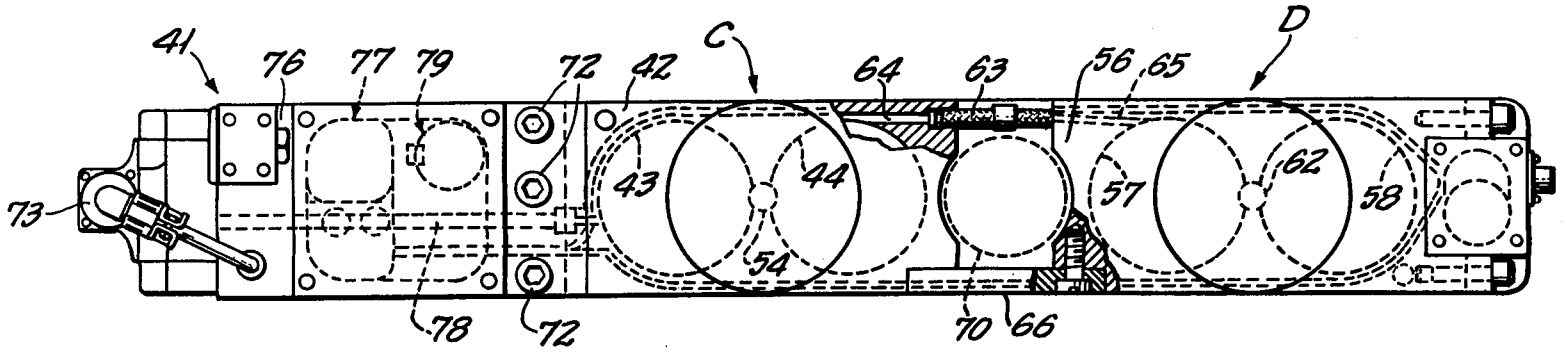
FIG. 5 is a plan view of the block of FIG. 4, partly broken-away and in section.

The dual-cylinder second unit D is of generally the description given for unit C. It comprises a body 56 having two closely adjacent cylinder bores 57–58 (FIG. 5) and associated pistons 59–60 which project below body 56 for large-area thrusting contact with the upper surface of the lower back-up roll chock projection 33. As with piston 47, a locating bolt 61 in the center of the base end of piston 60 is received in a local bore in the upper surface of projection 33. The upper or head ends of cylinders 57–58 communicate via a local opening beneath an air-bleed plug 62. Fluid pressure in unit C is communicated to the cylinders of unit D via flexible-hose means 63 connecting body passages 64–65 of the respective units. Finally, shims 68(69) having a dowel-pin location to the upper surface of bodies 42(56) provide the means of distributing load-transfer forces from the respective units C–D, to upper-chock projection 26. And link mechanism, such as a four-bar linkage involving links 66–67 and vertically spaced points of their loosely pinned connection to bodies 42–56, provides a degree of freedom, for units C–D to articulate in response to differing deformation of chock regions 26–33 of contact with the load-transfer block; a third link (not shown), similar to link 67 but loosely connecting bodies 42–56 beneath hose 63, provides enhanced integrity in the articulated connection of bodies 42–56.

Anticipating possible failure of the hydraulic circuitry in a load-transfer block, the bottom-closure plate 53 may be selected for such thickness that pistons 47–48 normally project to a minimal extent below plate 53; thus, upon failure of hydraulic pressure in cylinders 43–44, the full compression load of prestress action on chocks 22–30 may be taken or at least importantly shared by the solid metal bulk of bodies 42–56, thereby eliminating or substantially reducing damage to the working rolls or to the back-up rolls upon run-out of stock to be rolled.

In the region between links 66–67 on one side, and hose 63 (and another link, not shown) on the other side, adjacent ends of body 42 and body 56 are recessed to provide clearance for a cylindrical piston 70. Piston 70 will be understood to be a hydraulically actuated component of the lower back-up roll chock 30, forming no part of the present invention but serving to facilitate roll assembly and disassembly with respect to the mill, in that piston 70 may provide a convenient jack function to temporarily hold chocks 22–30 sufficiently spaced for such assembly purposes.

The hydraulic control unit 41 which forms a closely integrated component of each load-transfer block 40 is built into a body 71 having tongue-and-groove replaceable fit to the outer end of body 42 of unit C, the fit being secured by bolts 72. Control unit 41 is shown with a solenoid-operated servo valve 73, which will be understood to determine whether passage 55 (and, therefore, all of cylinders 43–44–57–58) will be supplied with inlet high pressure fluid from line 74, or will be connected for exhaust of fluid into line 75, or will be locked against change of fluid volume. Also contained within control unit 41 are means 76 for bleeding air out of the hydraulic system, electrical transducer means 77 (connected to the hydraulic line 78 from valve 73 to passage 55) for providing analog electrical signals responsive to instantaneous cylinder pressure, and a linear vertical-displacement transducer (LVDT) 79, which may be a Model No. 250MHR product of Schaevitz Engineering, of Pennsauken, N.J.

The pressure-transducer means 77 preferably comprises two like pressure-responsive devices having their respective pressure sensitive connections to line 78 on opposite sides of an orifice 78' in line 78; thus, the difference between electrical outputs of these two pressure transducers produces a directionally polarized electrical analog of hydraulic flow rate in line 78, while the one of these transducers which is closest to passage 55 produces an analog of instantaneous hydraulic-cylinder pressure. The flow-rate signal will be understood to be utilized local to the particular load-transfer block involved, for stabilizing purposes (e.g., anti-hunt and anti-overshoot, in hydraulic-system response), while the cylinder-pressure analog signal is used in coordinating the control of one with another of the load-transfer blocks 40 of the particular side of the mill, as will be more fully explained in connection with FIG. 6.

Coacting with the body and coil parts of transducer 79 is an armature rod 80 fixed to the outer end of lower chock 30, via bracket means 81, so that output signals of transducer 79 may provide a continuous analog of instantaneous displacement or offset between chocks 22–30, at the outer end of the load-transfer block. Similarly coacting between chocks 22–30 at the inner end of the load-transfer block is another LVDT device 82 having its body and coil fixedly mounted to cylinder body 56 and its armature rod mounted to a bracket 83 on chock 30. Flexible conductor cabling (not shown) will be understood to carry all transducer-sensed analog signals to a remote location, for evaluation at microprocessor means, to be described in connection with FIG. 6.

Figure 6:
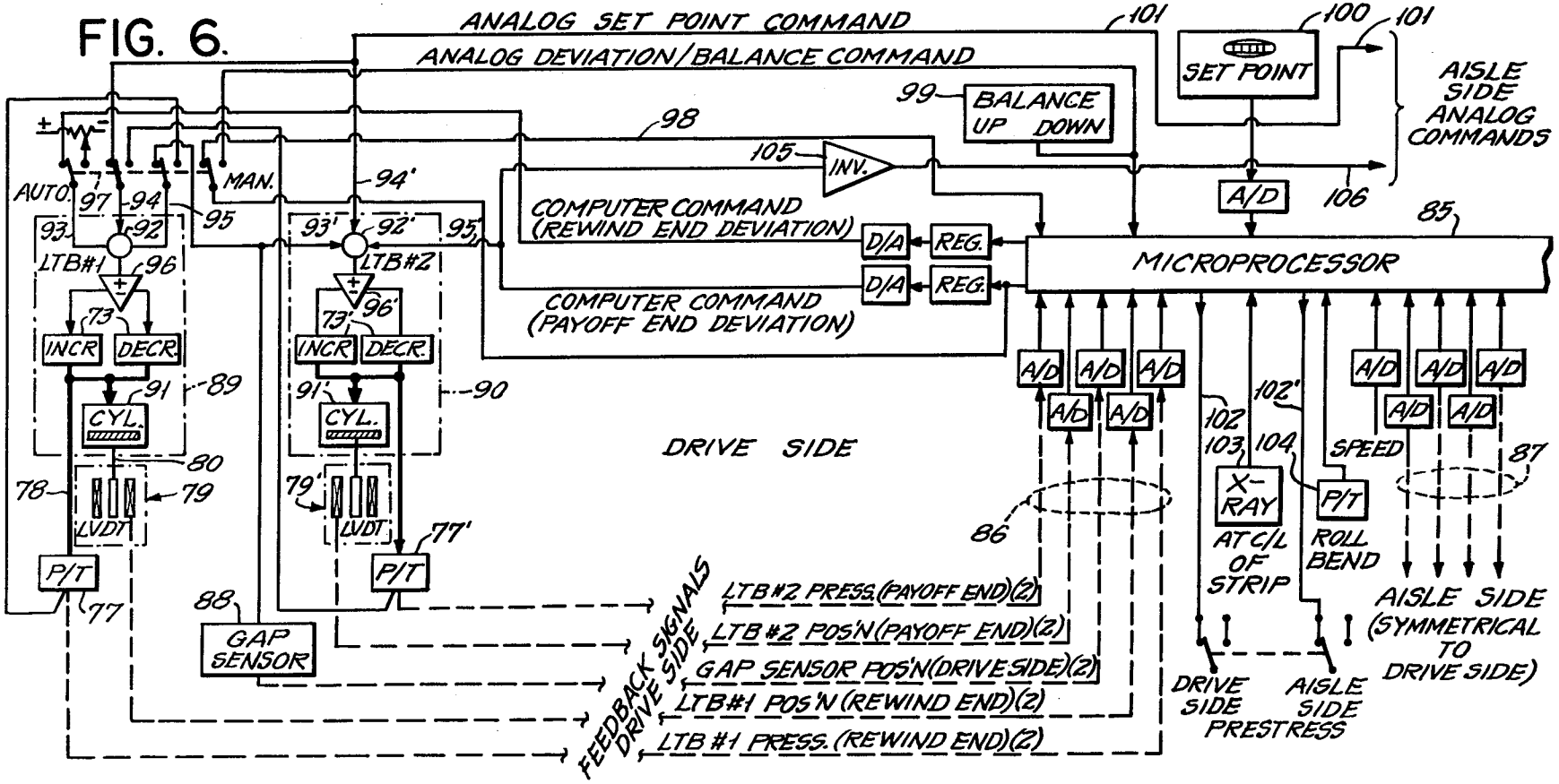
FIG. 6 is a circuit diagram schematically indicating electrical means for monitored and coordinated control of the plural load-transfer blocks in the mill of FIG. 1.
Figure 6A:
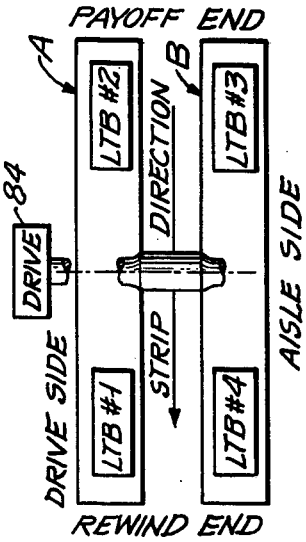
FIG. 6A is a simplified diagram of positional and motion relationships, in aid of FIG. 6.

In discussing the electrical sensing and control system of FIG. 6 it is convenient to rely on a convention of relative positioning and motion, schematically shown in FIG. 6A, wherein the direction of strip motion is indicated as right-to-left, and drive to the roll system is imparted by motor means 84 on the A or DRIVE side of the mill, the other (B) side being called the AISLE side of the mill. The respective load-transfer blocks 40 are schematically designated LTB#2 and LTB#3 on the supply or Payoff End, and LTB#1, and LTB#4 on the exit or Rewind End of the mill.

The heart of the control system is a microprocessor 85 having a plurality of sensed input connections, all of which have been shown by A/D symbolism to be converted from analog to digital form for microprocessor-input purposes. A first grouping of these input connections is specific to the aisle side, being generally designated 86, and will be understood to comprise separate analog electrical signals indicative of (a) instantaneous hydraulic pressure sensed by transducer 77 at payoff end LTB#2, (B) instantaneous chock (22 vs. 30) position as by adding the outputs of LVDT's 79 and 82 at payoff-end LTB#2, (c) instantaneous hydraulic pressure sensed by transducer 77 at rewind-end LTB#1, and (d) instantaneous chock (22 vs. 30) position as by adding the outputs of LVDT's 79 and 82 at rewind-end LTB#1; a second such grouping 87 of aisle-side microprocessor inputs is only schematically suggested, being totally analogous to the described drive-side connections except for their response to aisle-side pressure and position at LTB#3 and LTB#4, respectively. A fifth drive-side input connection is shown for the analog output of a gap sensor 88 which will be understood to monitor instantaneous rolled-strip thickness; the gap sensor 88 is not part of the load-transfer block of FIGS.

2 to 5, and is preferably of a construction described in detail in U.S. Pat. No. 4,044,580.

Each of the load-transfer blocks (LTB#1 and LTB#2) on the drive side is schematically shown by phantom outline 89–90, respectively, to be a complete analog electrohydraulic closed-loop subsystem, within which hydraulic lines are drawn thick, in contrast with thinner lines for electrical connections. The four cylinders of LTB#1, being series-connected, are merely schematically shown as effectively a single cylinder system 91, responding to actuation of servo valve 73 to a fluid-supply position (designated INCR.) to increase pressure and therefore spread action of LTB#1; cylinder system 91 responds to actuation of servo valve 73 to a fluid-exhaust position (designated DECR.) to bleed a release of fluid from cylinder system 91, to thereby decrease pressure and thus reduce the spread action of LTB#1. The indicated pressure transducer 77 at LTB#1 monitors the pressure in line 78, and piston displacement may be monitored by LVDT 79 alone or, as mentioned above, by summation of the outputs of the two LVDT's (79–82). What has been said for the closed-loop subsystem 89 for LTB#1 applies equally for each of the other three subsystems, and for the case of subsystem 90 the inner components are shown with primed notation.

To determine whether servo valve 73 is or is not to be operated and, if so, its direction of operation (INCR. vs. DECR.), a summation circuit 92 is shown connected for response to signals in lines 93–94–95, and suitable amplifier means 96 responds to the instantaneous summation to provide a directionally polarized output which, to the extent it exceeds a predetermined threshold, is operative to determine one or the other of the directional actuations of valve 73, from its central hydraulically locked position.

A four-pole double-throw switch 97 is selectively operable to determine mill operation, in its manual (MAN) mode or in its automatic (AUTO) mode. Three of the poles of switch 97 serve lines 93–94–95, respectively; the fourth pole determines whether payoff-end deviation (one of the two digital "Computer Command" outputs of microprocessor 85) shall be a direct feedback connection via line 98 to the microprosessor (AUTO mode) or whether such feedback shall be via manually adjustable means 99 whereby up/down balance may be adjusted (MAN mode). The said tension-end deviation command signal is also shown connected, via suitable register (REG.) and digital/analog-converter means, to input line 95' to the summation circuit 92' for subsystem 90 at LTB#2 (payoff end). The other computer command output (rewind-end deviation) of the microprocessor, similarly processed and converted to analog form, is directly connected to line 93 to summation circuit 92 for subsystem 89 at LTB#1, when switch 97 is set for AUTO mode; in the MAN mode, a potentiometer connection is substituted for the computer command to the rewind-end subsystem, to enable a set-up adjustment, to be subsequently matched by register (REG.) setting at the appropriate computer command output of the microprocessor.

The all-important reference input control to microprocessor 85 is the set-point adjustment, shown at 100 to provide an analog signal in line 101 to each of the drive-side subsystem summation circuits 92–92', and in line 101' to the corresponding parts of the aisle-side subsystems. This analog signal is converted to digital form in its supply to the microprocessor. In the MAN mode, the set-point signal connection is replaced by the position feedback signal from payoff-end transducer 77', while a gap-sensor (88) tracking connection to summation input 95 is replaced by a tracking connection to the output of pressure transducer 77; the gap-sensor (88) tracking connection to summation input 93' at payoff-end subsystem 90 remains unaffected, since MAN vs. AUTO setting of switch 97 is concerned primarily with permitting adjustment of the rewind-end subsystems in relation to the payoff-end subsystems. An inverter 105 in command line 106 to the payoff-end subsystem on the aisle side, will be understood to enable such corrective balancing of drive-side and aisle-side LTB actuations as to assure true alignment of strip supplied to the mill, in spite of thickness variations or hardness variations instantaneously transversely distributed across the supplied strip.

Connections to microprocessor 85 further include output lines 102–102' for the control of prestress loading at 36, for the drive and aisle sides, respectively, and as previously indicated, such prestress loading may be via electrically driven screw means, or hydraulic.

In spite of the set-point provision at 100, it is preferred that set-point responsive command functioning within microprocessor 85 shall be subject to long-term (i.e., relatively slow) automatic correction of the set point, based on employment of an X-ray source and detector 103 positioned to continuously monitor and to provide the ultimate standard for achieving desired thickness of rolled strip product, as will be more fully discussed below, in connection with FIG. 7C; because the X-ray observation is necessarily a physical distance (e.g., 25 to 30 inches) downstream from the working rolls 12–13, the inputs to microprocessor 85 are shown to include a mill-speed input, whereby the strip-travel time between rolls 12–13 and the point of X-ray observation may be suitably accommodated in any determination of need for set-point correction. The inputs to microprocessor 85 are also shown to include a roll-bend signal from a pressure transducer 104, in a manner and for a purpose more fully discussed in connection with FIG. 7E.

The foregoing discussion in connection with FIGS. 6 and 6A will be understood to be general, i.e., for general identification of components having a variety of different cooperative relations which are or may be performed and coordinated through microprocessor means 85. For greater clarity of description, five of these relationships are separately and schematically depicted in FIGS. 7A to 7E, respectively, there being in each case a showing only of such operational use of the microprocessor as is specifically applicable to the involved relationship. More specifically, microprocessor means 85 will be understood to incorporate provision for time-multiplexing of all inputs and outputs, the multiplex-cycle rate being of megahertz order of magnitude and thus very much faster than any time constants of response of involved mechanical components or of electrical analog signals within the sensing and control system; moreover, the multiplexing capability of means 85 will be understood to apply to the suitably interlaced operation of various programmed internal functions of means 85. That being the case, multiplexing is not specifically shown in the drawings but is symbolized by the schematic phantom enclosure 85. Still further, means 85 operates digitally and therefore all input and output connections to analog components will be understood to include appropriate conversion devices, exemplified in FIG. 7A by "A/D" elements for inputs to means 85 and by "D/A" elements for outputs therefrom; for simpler discussion of ensuing FIGS. 7B to 7E, "A/D" and "D/A" elements have been omitted but will be understood to be provided, as in FIG. 7A, for the respective input and output connections to means 85.

Finally, for illustrative context, it may be noted that the response time of the hydrauluc circuit associated with each of the load-transfer blocks (LTB#1 to #4) is in the order of 0.003 second, that the mill-exit speed of aluminum strip in a mill of above-described proportions may be in the order of 60 miles/hour (corresponding to about one inch per millisecond), and that although the X-ray detector response time constant is about 1/10 second, it is preferred to evaluate and use X-ray detector response on an averaged basis, the average being taken for a much longer interval, e.g., in the order of 5 seconds.

Figure 7A:
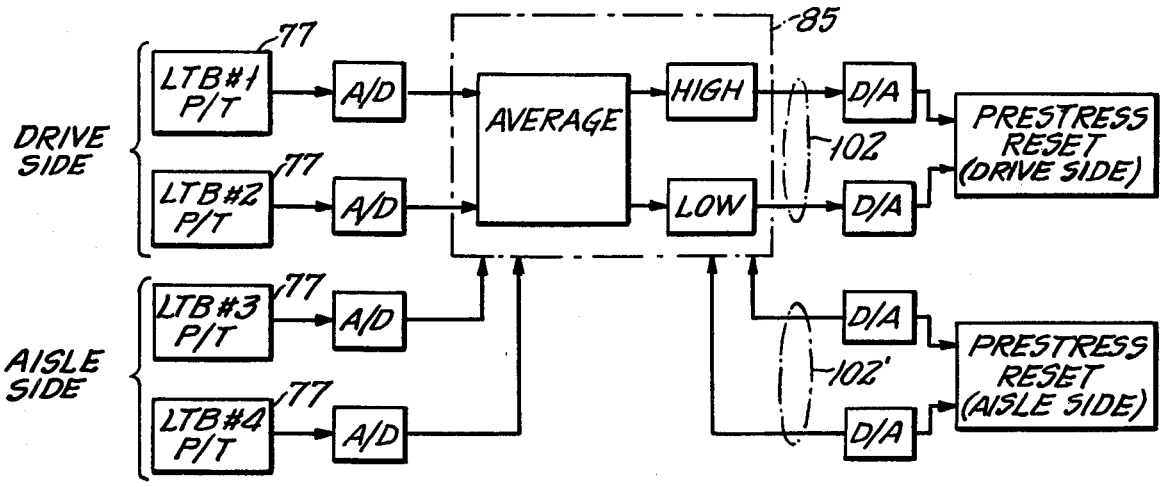
FIGS. 7A through 7E are simplified block diagrams to illustrate the segregative functional aspects of control of plural load-transfer blocks in the middle of FIG. 1.

FIG. 7A illustrates pressure monitoring of load-transfer block operation, for control of prestress setting, to the end that hydraulic pressures within all load-transfer blocks shall remain realistically within the capacity of the source of hydraulic pressure, thus assuring that displaced volume of hydraulic fluid will be kept to a minimum and that the approximately 0.003-second response will be maintained for all load-transfer blocks; for example, utilizing a hydraulic source having a nominal supply pressure of 2,000 psi, it is desirable to so adjust the prestressing means 36 on each side of the mill, i.e., on the drive side and on the aisle side, that monitored hydraulic pressures on the cylinder side of the flow-measuring orifice 78 between pressure-sensing taps of transducer 77 shall not exceed 1500 psi (high) or drop below 500 psi (low). To achieve this result in FIG. 7A, the continuously available analog-signal values of such pressure in the drive-side load-transfer blocks (LTB#1 and LTB#2) are converted to digital form for summation or averaging within the microprocessor; a high-limit signal appears in output 102, should this average exceed the predetermined high threshold, and a low-limit signal output signifies that the average detected pressure on the drive side is below the predetermined low threshold. After conversion to analog form, the applicable "high" or "low" signal is correctively applied to reset the drive-side prestressing means 36, the direction of corrective application of prestress reset being to enable monitored pressure to stay within the indicated high and low limits. Similar elements perform similar functions for corrective reset of the aisle-side prestressing means 36, it being understood that the time-multiplexing or commutating nature of microprocessor 85 enables interlaced use of the same averaging and high and low threshold responses (within means 85) to effectively independently serve both sides of the mill.

Figure 7B:
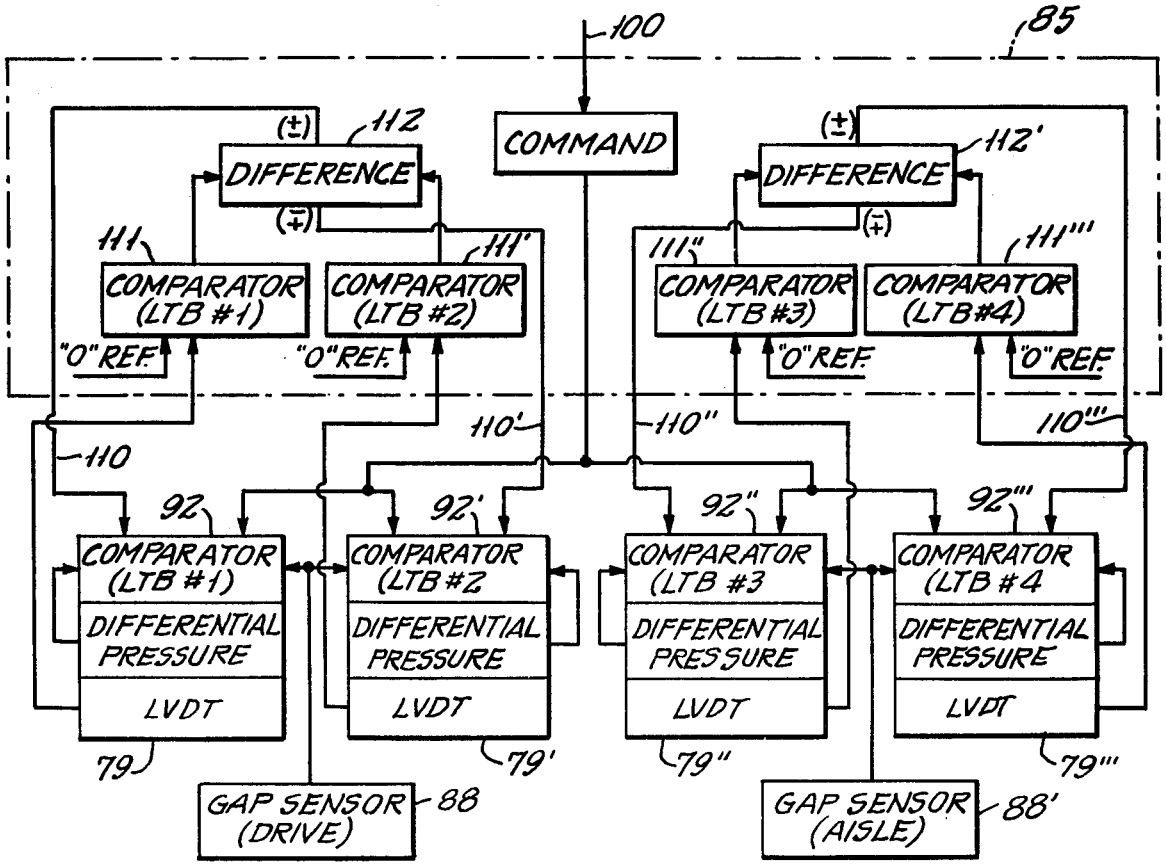

FIG. 7B illustrates means whereby for a given set point or command (to produce a predetermined rolled-strip thickness), LVDT outputs are differentially evaluated to effectively balance exit vs. entrance load-transfer block action on the drive side of the mill, independent of the aisle side. Thus, the comparator or summation circuit 92 for LTB#1 and the similar circuit 92' for LTB#2 each receive the same command signal from the microprocessor (as well as the same sensed roll-gap signal from sensor 88); but this command signal is "balanced" or differentially corrected, in opposite sense and to the same degree, via balancing connections 110–110' to the respective comparators 92–92'. More specifically, the output of LVDT 79 associated with LTB#1 is monitored at 111 (with respect to a predetermined or "0" reference value) within the microprocessor, while the output of LVDT 79' associated with LTB#2 is similarly monitored at 111', and the thus-monitored values are observed at 112 for the poled sense and magnitude of their difference; ± and ∓ symbols at the respective outputs of means 112 to lines 110 and 110' will be understood to suggest the equal and opposite nature of the thus-derived balancing-signal inputs to comparators 92–92'. Similar use of aisle-side LVDT's 79'' and 79''' will be seen from FIG. 7B to apply for exit/entrance balance control of LTB#3 and LTB#4, via their respective comparators 92'' and 92'''. And to assure a fluid-flow or rate response at each load-transfer block, the so-called on-board electronic logic 92 associated with each load-transfer block is schematically shown with an input served by the associated differential-pressure signal output of the local transducer means 77 (i.e., signal responsive to the pressure drop across orifice 78').

Figure 7C:
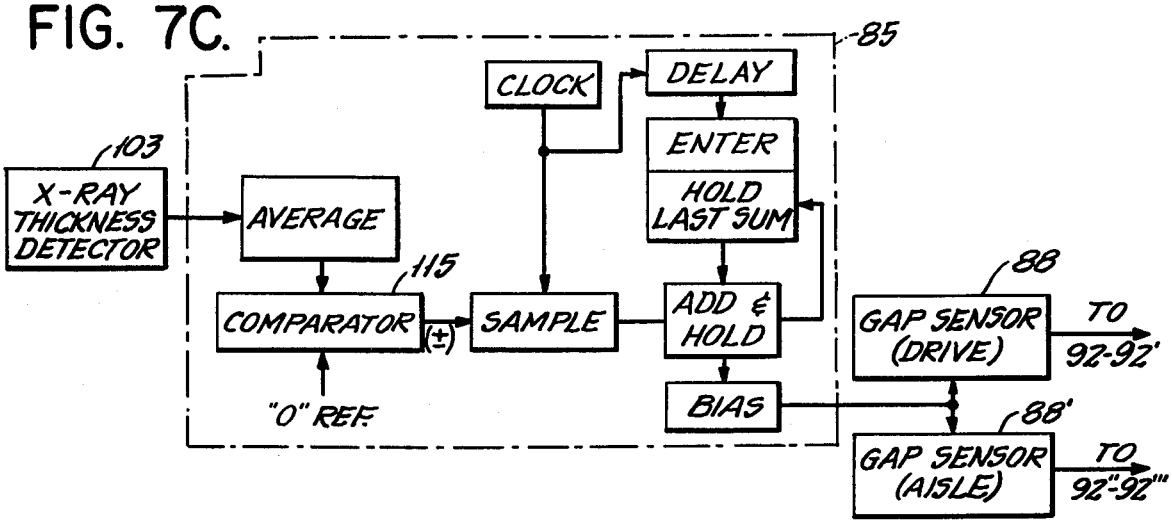

FIG. 7C illustrates means whereby the output of X-ray detector 103 may be used, in total reliance upon the validity of absolute thickness determined thereby, to generate long-term corrective adjustment, in compensation for any long-term drift in system operation; specifically, in FIG. 7C, output of detector 103 is shown to develop a corrective or bias signal to both gap sensors 88–88' as a means of effectively modifying or adjusting the operative effect of the command signal upon the on-board electronic logic circuitry 92 of each load-transfer block. As shown, within the microprocessor, the output of detector 103 is redundantly observed to develop an average level which is compared against a calibration preset or "0" reference. A clock-timed sampling of the magnitude and sense of the comparator output is, for each sampling, added to (i.e., averaged with the most-recent previous summation), to develop the current value for bias purposes; as shown, clock timing with a delay (as compared to sample timing) provides sufficient timed interlace of the currently operative adding function, in relation to retention of the most-recently entered previous summation, that the latter is always in readiness for addition to (i.e., averaging with) the currently sampled value. The period between samplings should be sufficient to allow for any and all corrections to be made and to appear at the downstream location of detector 103; this may be achieved by having the sampling interval determined as a function of the mill-speed input, but in the form shown, a clock determines the interval between samplings. Finally, the directional sense of bias output to gap sensors 88–88' will be understood to be such as to reduce the average of X-ray detector (103) output to zero deviation from the calibration or "0"-reference at comparator 115.

Figure 7D:
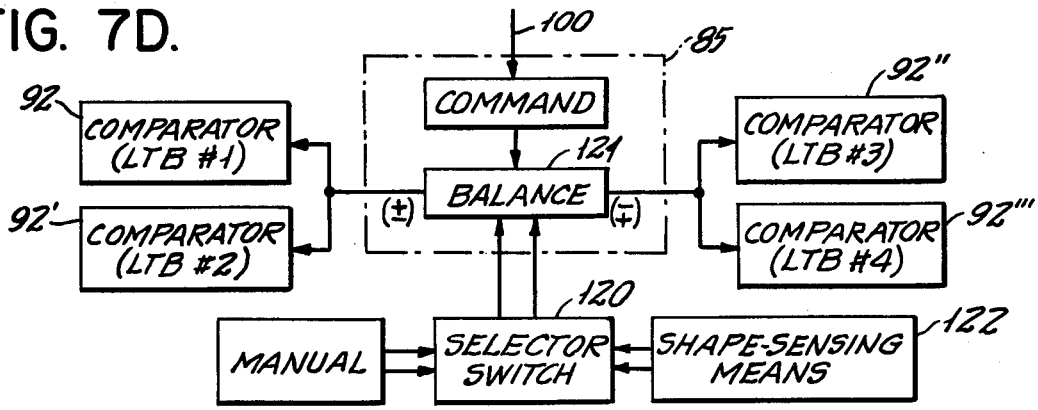

FIG. 7D illustrates means whereby working-roll coaction on the respective sides of the mill may be balanced to assure a straight run of rolled-strip product, i.e., to offset any noted tendency of the product to sag or undulate on one side with respect to the other side. The need for effecting such a balance correction may be noted visually by the mill operator, in which case a selector switch 120 will have been set for manual control of side-to-side balance. Within the microprocessor 85, a balancing network 121 is interposed between the command network and the LTB comparators 92–92' and 92''–92''' on the respective sides of the mill. As the (±) and (∓) symbolism suggests, the respective outputs of network 121 to the drive-side and aisle-side load-transfer blocks represent equal and opposite trimming corrections in delivery of the current command signal to the respective sides, subject to the manual control of direction and magnitude of the balancing correction. Of course, the correction is made until product is observed to be uniform (i.e., to match in appearance) on both sides of the mill. Alternatively, the balancing correction may be effected automatically upon selection of switch 120 for balance control by means 122 responsive (e.g., by photoelectric means) to detected changes in shape for rolled-strip product on the respective side edges thereof, and at corresponding downstream locations, as will be understood.

Figure 7E:
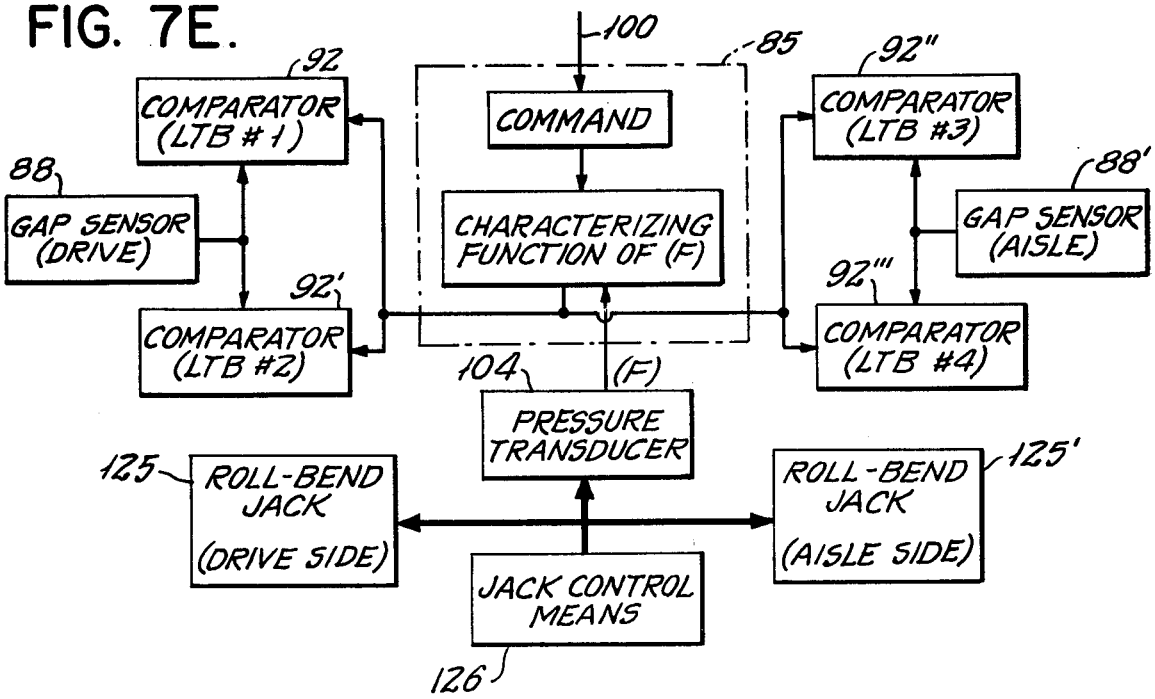

FIG. 7E illustrates a still further control feature achievable via load-transfer block control and utilizing the microprocessor 85, for the situation in which the mill is equipped with jack means 125–125' on the respective drive and aisle sides for purposes of reducing so-called roll-bend effects. Each such jack will be understood to be hydraulically actuated to exert spreading force between the working-roll shaft ends (i.e., between chocks 23–31 at its end of the mill); such jacks are not shown in FIG. 1 and are merely schematically shown in FIG. 7E. Jacks 125–125' are supplied in parallel by pressure fluid via control means 126, and a pressure transducer provides an electrical signal output indicative of instantaneous "roll-bend" pressure. The non-linear relation between roll-bend pressure and product thickness for the particular (a) working material (e.g., aluminum), (b) roll size and speed, (c) strip reduction, and other factors, will have been ascertained empirically, and this relation will have been entered as a characterizing feature of a network 127 in series with command connections to the comparators 92 of all load-transfer blocks. This being the case, all previously described automatic features of load-transfer block control may proceed, with additional correction for the roll-bend force-to-thickness correction. Thus, by means of the circuitry of FIG. 7E, all command and gap-sensor signals may be designed to produce a given product thickness at the edges and at the center and the roll-bend correction also applies to those signals which have been effectively trimmed against long-term drift by reason of the X-ray monitoring described in connection with FIG. 7C.

The described load-transfer blocks and their coordinated monitoring and control will be seen to effect very substantially improved control of quality, thickness and uniformity of rolled-strip product, whatever the material processed by the mill (e.g., steel and, therefore, not necessarily aluminum). The basic limitation of response time in which to achieve a corrective setting is the hydraulic response time of each of the load-transfer blocks; as noted above, this is of the order of 0.003 second, a very substantial improvement over prior and existing practice. The use of microprocessor 85 enables each of a plurality of significant variables to be effectively continuously monitored, at multiplexed sampling rates many orders of magnitude faster than the hydraulic-response times, and the described various circuit arrangements of FIGS. 7A to 7E illustrate control of the mill, virtually independent of the prestress-loading mechanism, be it screw-loaded or hydraulically loaded at 36; and since most mills in use today are prestressed via screw-actuated means, the invention will be seen as directly applicable to the upgrading of such existing mills, adding Vernier-like precision and vastly shorter response time to control of the working rolls.

The various circuit arrangements, serving the mill via all four LTB locations, will be seen to be illustrative of:

A. In FIG. 7A, drive-side sensing of a physical quantity (drive-side average hydraulic pressure, monitored for retention within high and low levels of tolerance) to determine whether and in what sense there shall be a drive-side correction (of drive-side prestress setting); the drive-side monitoring and drive-side control is in high-speed multiplexed interlace and therefore effectively concurrent with corresponding aisle-side monitoring and aisle-side control.

B. In FIG. 7B, a given physical quantity (LVDT position) at the rewind-end LTB and at the payoff-end LTB of the drive side is, after evaluation against its own "0" reference, differentially evaluated to develop an entrance vs. exit balancing (±; ∓) command-signal correction to be applied to the involved LTB#1 and LTB#2 on the drive side; a similar processing of LVDT outputs on the aisle side concurrently develops balancing correction of the command signal applied to aisle-side LTB#3 and LTB#4. And in each case, the corrected command signal is applied in suitably compared relation to instantaneous working-roll gap, as locally sensed at the drive side or at the aisle side, as applicable.

C. In FIG. 7C, a basic ultimate physical property (X-ray detected thickness of rolled-strip product) is continuously monitored to develop a long-term anti-drift corrective adjustment, applicable alike to both sides of the mill, being shown as corrections of gap-sensor outputs and therefore effectively as long-term reset adjustments of the command signal.

D. In FIG. 7D, product shape is an illustrative property which may be visually or automatically monitored to determine whether and in which sense and magnitude a drive-side vs. aisle-side balancing adjustment is to be made in the command signal delivered to the on-board electronics of load-transfer blocks at the respective sides of the mill.

E. In FIG. 7E, a physical quantity at both the drive-side and the aisle-side (instantaneous roll-bend jack pressure) is monitored against a precharacterized function of jack force to apply like corrective modification to the command to all load-transfer blocks.

While the invention has been described in detail for a preferred embodiment it will be understood that modification may be made without departing from the invention. For example, each load-transfer block has been described in the context of having two LVDT's (79–82, at the respective ends of the load-transfer block) the outputs of which are summed or averaged. Actually, only one of these LVDT's would do the required job, once the load-transfer block is installed with correctly matching shims at 68–69; however, the second LVDT will be seen, in conjunction with a selectively operable switch for set-up purposes, to enable set-up checking of the matching effectiveness vel non of particular shims 68–69, inasmuch as LVDT outputs at a given load-transfer block will be different unless the shims are correctly matched.

Further, it will be understood that reference at 122 in FIG. 7D, to shape-sensing means for automatic control of right-to-left (i.e., drive-side vs. aisle-side) balance action is a general reference to a selected one of currently available devices or systems which, in the case of the so-called VIDIFOIL system of Loewry Robertson Engineering Company Ltd., of Poole, Dorset, England, is tension-sensitive rather than photoelectric.

It will also be understood that while the invention has great immediate utility in up-grading application to existing mills, the load-transfer concept and its coordinated control may be embodied in structure built into one or both the back-up roll chocks per se, i.e., it is not necessarily a requirement of the invention that the load-transfer mechanism be in the form of a unit-handling block, removably inserted between corresponding opposed legs of the involved chocks.

What is claimed is:

1. A rolling mill comprising two horizontally spaced parallel upstanding end housings, two vertically spaced working rolls extending horizontally between said housings and establishing a pass from an entry side to an exit side for through-travel of material to be rolled, a back-up roll vertically behind each of said working rolls, a back-up roll chock at each end of each of the back-up rolls and providing rotary bearing support for the respective ends of the back-up rolls, chock-support means including a vertical chock guide in each of said housings for accommodating at each end housing vertical displacement of at least one of said back-up rolls, loading means at each end housing for urging the associated chocks toward each other to force the back-up rolls against the working rolls to load the working rolls, and a load-transfer block between associated chocks on both the entry side and the exit side of said pass, each said load-transfer block comprising a unitary assembly of plural vertical-action hydraulic piston-cylinder units in elongate articulated interconnected array, the length of the array providing plural horizontally spaced regions of load-opposing vertical spreading-force application to the associated back-up roll chocks, a separate hydraulic fluid supply and control system forming part of and connected for exclusive service of the piston-cylinder units of each load-transfer block assembly, and means including a microprocessor with separate pressure-sensing and piston-position sensing and hydraulic-control connections to all said load-transfer blocks for automatically controlling the relative chock-spreading actions of said respective load-transfer blocks.

2. A rolling mill comprising two spaced parallel upstanding side housings, two vertically spaced horizontal working rolls establishing a pass from an entry to an exit for through-travel of material to be rolled between said side housings, a back-up roll vertically behind each of said working rolls, a back-up roll chock at each end of each of the back-up rolls and providing rotary support for the respective ends of the back-up rolls, chock-support means including a vertical chock guide in each of said side housings for accommodating at each side housing vertical displacement of at least one of the back-up rolls, prestress-loading means at each side housing for urging the associated chocks toward each other to force the back-up rolls against the working rolls to load the working rolls, and four load-transfer blocks there being one between associated chocks on both the entry side and the exit side of each of said side housings, each load-transfer block comprising hydraulic piston-cylinder means providing spreading-force application to the associated back-up roll chocks, a separate hydraulic fluid supply and control system forming part of and connected for exclusive service of the piston-cylinder means of each load-transfer block, and means including a microprocessor with separate pressure-sensing and piston-position sensing and hydraulic-control connections to all said load-transfer blocks for automatically controlling the relative chock-spreading actions of said respective load-transfer blocks.

3. The mill of claim 2, in which said microprocessor means includes means for averaging the respective pressure-sensing outputs of the load-transfer blocks at one side housing and for evaluating the average in respect of predetermined upper and lower limits of a predetermined operating range of average pressure, said microprocessor means producing an output control signal polarized according to whether the upper or the lower of said limits is traversed, and means responsive to said output control signal for correctively controlling the prestress-loading means at one said side housing, the directional sense of control being to retain load-transfer block hydraulic operation at said one side housing within said predetermined operating range.

4. The mill of claim 3, in which said microprocessor means includes first multiplexing means sequentially and periodically associating with said averaging and evaluating means the pressure-sensing outputs of the load-transfer blocks at one side housing with those at the other side housing, and second multiplexing means sequentially and periodically associating the control-signal output of said evaluating means with the prestress-loading means at the respective side housings.

5. The mill of claim 2, in which said microprocessor means includes means for differentially evaluating the respective position-sensing outputs of the load-transfer blocks at one side housing, the evaluation producing two output signals of equal magnitude and opposed polarity reflecting such differential evaluation, said respective output signals being operatively connected to the control system of each of the respective load-transfer blocks at said one side housing, the directional sense of control being to maintain uniform position-sensing outputs of the load-transfer blocks at said one side housing.

6. The mill of claim 5, in which said microprocessor includes first multiplexing means periodically associating with said differentially evaluating means the position-sensing outputs of the load-transfer blocks at one side housing with those at the other side housing, and second multiplexing means periodically associating the two output signals of said differentially evaluating means with the control system of each of the respective load-transfer blocks at the respective side housings.

7. The mill of claim 6, in which said microprocessor means includes in each of the input connections to said differentially evaluating means a comparator providing a predetermined "0" reference signal magnitude against which the applicable position-sensed output signal is differentially evaluated to determine a corrected position-sensed signal to said differentially evaluating means.

8. The mill of claim 6, in which a work-roll gap sensor is positioned between load-transfer blocks at each side housing, each gap sensor producing an electrical signal output responsive to instantaneous roll-gap magnitude, said electrical signal output being connected in parallel to the control system of each of the load-transfer blocks at the applicable side housing.

9. The mill of claim 8, including set-point command means producing an electrical command signal connected in parallel to the control system of each of the load-transfer blocks of the mill.

10. The mill of claim 2, including set-point means producing an electrical command signal connected in parallel to the control system of each of the four load-transfer blocks of the mill, and a work-roll gap sensor positioned between load-transfer blocks at each side housing, each gap sensor producing an electrical signal output responsive to its local detection of instantaneous roll-gap magnitude, said electrical signal output being connected in parallel to the control system of each of the two load-transfer blocks at the applicable side housing, each control system including means comparatively evaluating its respective command-signal and sensed-gap signals to determine control-system operation of the associated separate hydraulic fluid supply.

11. The mill of claim 10, and including thickness-detection means located downstream from the region of working-roll action on material exiting said pass, said thickness-detection means producing an electrical output signal responsive to detected rolled-strip thickness, said microprocessor means including signal-averaging means responsive to the electrical signal output of said thickness-detection means, and an output-signal connection from said averaging means in parallel to the control system of each of said load-transfer blocks.

12. The mill of claim 11, in which said thickness-detection means includes an X-ray source and detector positioned to span rolled-strip product at a central location between sides of the rolled strip.

13. The mill of claim 2, in which said microprocessor means includes set-point command means producing an electrical signal having first parallel connection to the control system of each of the two load-transfer blocks at one side housing and second parallel connection to the control system of each of the two load-transfer blocks at the other side housing, and balancing means interposed between said command means and said control systems, said balancing means having an input connection from said command means and a separate output to each of said first and second parallel connections, said balancing means including provision for input control of equal and opposite incremental modifications of the command signal output to said separate outputs in terms of increasing the command signal level in one of said outputs to the same extent as the decrease of command signal level in the other of said outputs.

14. The mill of claim 13, in which said balancing means is selectively variable by manual means.

15. The mill of claim 13, in which automatic shape-sensing means responsive to product slack on one side of the product as compared with other side produces an electric-signal output in controlling relation with said balancing means, the directional sense of said electric-signal output being such as to reduce to zero the difference in detected slack on both sides of the product.

16. The mill of claim 2, wherein hydraulic roll-bend jack means at each side housing provides spreading force between corresponding ends of said working rolls, and jack-control means including a supply of hydraulic pressure fluid to both jack means in parallel, a pressure-sensitive transducer connected to said supply and producing an electrical signal output reflecting sensed jack-fluid pressure, said microprocessor means including set-point command means producing an electrical signal having first parallel connection to the control system of each of the load-transfer blocks at one side housing and having second parallel connection to the control system of each of the load-transfer blocks at the other side housing, and precharacterized network means interposed between said command means and said control systems, said network means being characterized in accordance with predetermined mill response to roll-bend jack force, and said network means having an input connection from said command means and having output connections in parallel to all control systems at both side housings.

17. A rolling mill comprising two spaced parallel upstanding side housings, two vertically spaced horizontal working rolls establishing a pass from an entry to an exit for through-travel of material to be rolled between said side housings, a back-up roll vertically behind each of said working rolls, a back-up roll chock at each end of each of the back-up rolls and providing rotary support for the respective ends of the back-up rolls, chock-support means including a vertical chock guide in each of said side housings for accommodating at each side housing vertical displacement of at least one of the back-up rolls, prestress-loading means at each side housing for urging the associated chocks toward each other to force the back-up rolls against the working rolls to load the working rolls, and four load-transfer mechanisms there being one associated with and reacting between associated chocks on both the entry side and the exit side of each end of said side housings, each load-transfer mechanism comprising hydraulic piston-cylinder means providing spreading-force application to the associated back-up roll chocks, a separate hydraulic fluid supply and control system forming part of and connected for exclusive service of the piston-cylinder means of each load-transfer mechanism, and means including a microprocessor with separate pressure-sensing and piston-position sensing and hydraulic-control connections to all said load-transfer mechanisms for automatically controlling the relative chock-spreading actions of said respective load-transfer mechanisms.

18. A rolling mill comprising two spaced parallel upstanding side housings, two vertically spaced horizontal working rolls establishing a pass from an entry to an exit for through-travel of material to be rolled between said side housings, a back-up roll vertically behind each of said working rolls, a back-up roll chock at each end of each of the back-up rolls and providing rotary support for the respective ends of the back-up rolls, chock-support means including a vertical chock guide in each of said side housings for accommodating at each side housing vertical displacement of at least one of the back-up rolls, prestress-loading means at each side housing for urging the associated chocks toward each other to force the back-up rolls against the working rolls to load the working rolls, and four load-transfer mechanisms there being one associated with and reacting between associated chocks on both the entry side and the exit side of each of said side housings, each load-transfer mechanism comprising hydraulic piston-cylinder means providing spreading-force application to the associated back-up roll chocks, an independently operative hydraulic control system including a control valve connected for exclusive service of the piston-cylinder means of each load-transfer mechanism, and means including a microprocessor with separate pressure-sensing and hydraulic-control connections to all said load-transfer mechanisms for automatically controlling the relative chock-spreading actions of said respective load-transfer mechanisms.

19. A rolling mill comprising two spaced parallel upstanding side housings, two vertically spaced horizontal working rolls establishing a pass from an entry to an exit for through-travel of material to be rolled between said side housings, a back-up roll vertically behind each of said working rolls, a back-up roll chock at each end of each of the back-up rolls and providing rotary support for the respective ends of the back-up rolls, chock-support means including a vertical chock guide in each of said side housings for accommodating at each side housing vertical displacement of at least one of the back-up rolls, prestress-loading means at each side housing for urging the associated chocks toward each other to force the back-up rolls against the working rolls to load the working rolls, and four load-transfer mechanisms there being one associated with and reacting between associated chocks on both the entry side and the exit side of each of said side housings, each load-transfer mechanism comprising hydraulic piston-cylinder means providing spreading-force application to the associated back-up roll chocks, an independently operative hydraulic control system including a control valve connected for exclusive service of the piston-cylinder means of each load-transfer mechanism, and means including a microprocessor with separate piston-position sensing and hydraulic-control connections to all said load-transfer mechanisms for automatically controlling the relative chock-spreading actions of said respective load-transfer mechanisms.

20. A rolling mill comprising two spaced parallel upstanding side housings, two vertically spaced horizontal working rolls establishing a pass from an entry to an exit for through-travel of material to be rolled between said side housings, a back-up roll vertically behind each of said working rolls, a back-up roll chock at each end of each of the back-up rolls and providing rotary support for the respective ends of the back-up rolls, chock-support means including a vertical chock guide in each of said side housings for accommodating at each side housing vertical displacement of at least one of the back-up rolls, prestress-loading means at each side housing for urging the associated chocks toward each other to force the back-up rolls against the working rolls to load the working rolls, and four load-transfer mechanisms there being one associated with and reacting between associated chocks on both the entry side and the exit side of each of said side housings, each load-transfer mechanism comprising hydraulic piston-cylinder means providing spreading-force application to the associated back-up roll chocks, an independently operative hydraulic control system including a control valve connected for exclusive service of the piston-cylinder means of each load-transfer mechanism, first and second gap-sensor means positioned to sense working-roll gap at the respective ends of said pass, and means including a microprocessor with separate connections to said first and second gap-sensor means and with hydraulic-control connections to all said load-transfer mechanisms for automatically controlling the relative chock-spreading actions of said respective load-transfer mechanisms.

21. A rolling mill comprising two spaced parallel upstanding side housings, two vertically spaced horizontal working rolls establishing a pass from an entry to an exit for through-travel of material to be rolled between said side housings, a back-up roll vertically behind each of said working rolls, a back-up roll chock at each end of each of the back-up rolls and providing rotary support for the respective ends of the back-up rolls, chock-support means including a vertical chock guide in each of said side housings for accommodating at each side housing vertical displacement of at least one of the back-up rolls, prestress-loading means at each side housing for urging the associated chocks toward each other to force the back-up rolls against the working rolls to load the working rolls, and four load-transfer mechanisms there being one associated with and reacting between associated chocks on both the entry side and the exit side of each of said side housings, each load-transfer mechanism comprising hydraulic piston-cylinder means providing spreading-force application to the associated back-up roll chocks, an independently operative hydraulic control system including a control valve connected for exclusive service of the piston-cylinder means at each side housing, and means including a microprocessor with separate pressure-sensing and hydraulic-control connections to all said load-transfer mechanisms for automatically controlling the relative chock-spreading actions of said respective load-transfer mechanisms.

22. A rolling mill comprising two spaced parallel upstanding side housings, two vertically spaced horizontal working rolls establishing a pass from an entry to an exit for through-travel of material to be rolled between said side housings, a back-up roll vertically behind each of said working rolls, a back-up roll chock at each end of each of the back-up rolls and providing rotary support for the respective ends of the back-up rolls, chock-support means including a vertical chock guide in each of said side housings for accommodating at each side housing vertical displacement of at least one of the back-up rolls, prestress-loading means at each side housing for urging the associated chocks toward each other to force the back-up rolls against the working rolls to load the working rolls, and four load-transfer mechanisms there being one associated with and reacting between associated chocks on both the entry side and the exit side of each of said side housings, each load-transfer mechanism comprising hydraulic piston-cylinder means providing spreading-force application to the associated back-up roll chocks, an independently operative hydraulic control system including a control valve connected for exclusive service of the piston-cylinder means at each side housing, and means including a microprocessor with separate piston-position sensing and hydraulic-control connections to all said load-transfer mechanisms for automatically controlling the relative chock-spreading actions of said respective load-transfer mechanisms.

23. A rolling mill comprising two spaced parallel upstanding side housings, two vertically spaced horizontal working rolls establishing a pass from an entry to an exit for through-travel of material to be rolled between said side housings, a back-up roll vertically behind each of said working rolls, a back-up roll chock at each end of each of the back-up rolls and providing rotary support for the respective ends of the back-up rolls, chock-support means including a vertical chock guide in each of said side housings for accommodating at each side housing vertical displacement of at least one of the back-up rolls, prestress-loading means at each side housing for urging the associated chocks toward each other to force the back-up rolls against the working rolls to load the working rolls, and four load-transfer mechanisms there being one associated with and reacting between associated chocks on both the entry side and the exit side of each of said side housings, each load-transfer mechanism comprising hydraulic piston-cylinder means providing spreading-force application to the associated back-up roll chocks, an independently operative hydraulic control system including a control valve connected for exclusive service of the piston-cylinder means at each side housing, first and second gap-sensor means positioned to sense working-roll gap at the respective ends of said pass, and means including a microprocessor with separate connections to said first and second gap-sensor means and with hydraulic-control connections to all said load-transfer mechanisms for automatically controlling the relative chock-spreading actions of said respective load-transfer mechanisms.

24. A rolling mill comprising two spaced parallel elongate end housings, two spaced working rolls extending between said housings and establishing a pass from an entry side to an exit side for through-travel of material to be rolled, the direction of said pass being in a plane generally perpendicular to the geometric plane established by and between the longitudinal axes of the respective end housings, a back-up roll extending between said housings behind each of said working rolls, a back-up roll chock at each end of each of the back-up rolls and providing rotary bearing support for the respective ends of the back-up rolls, chock-support means including a chock guide within and in the elongate direction of each of said housings for accommodating displacement in said direction for at least one of said back-up rolls, loading means at each end housing for urging the associated chocks toward each other to force the back-up rolls against the working rolls to load the working rolls, and separate load-transfer mechanisms reacting between associated chocks at each end housing, each load-transfer mechanism comprising hydraulic piston-cylinder means providing spreading-force application to the associated back-up roll chocks, an independently operative hydraulic control system including a control valve connected for exclusive service of the piston-cylinder means of each load-transfer mechanism, and means including a microprocessor with separate pressure-sensing and hydraulic-control connections to said load-transfer mechanisms for automatically controlling the relative chock-spreading actions of said respective load-transfer mechanisms.

25. A rolling mill comprising two spaced parallel elongate end housings, two spaced working rolls extending between said housings and establishing a pass from an entry side to an exit side for through-travel of material to be rolled, the direction of said pass being in a plane generally perpendicular to the geometric plane established by and between the longitudinal axes of the respective end housings, a back-up roll extending between said housings behind each of said working rolls, a back-up roll chock at each end of each of the back-up rolls and providing rotary bearing support for the respective ends of the back-up rolls, chock-support means including a chock guide within and in the elongate direction of each of said housings for accommodating displacement in said direction for at least one of said back-up rolls, loading means at each end housing for urging the associated chocks toward each other to force the back-up rolls against the working rolls to load the working rolls, and separate load-transfer mechanisms reacting between associated chocks at each end housing, each load-transfer mechanism comprising hydraulic piston-cylinder means providing spreading-force application to the associated back-up roll chocks, an independently operative hydraulic control system including a control valve connected for exclusive service of the piston-cylinder means of each load-transfer mechanism, and means including a microprocessor with separate piston-position sensing and hydraulic-control connections to said load-transfer mechanisms for automatically controlling the relative chock-spreading actions of said respective load-transfer mechanisms.

26. A rolling mill comprising two spaced parallel elongate end housings, two spaced working rolls extending between said housings and establishing a pass from an entry side to an exit side for through-travel of material to be rolled, the direction of said pass being in a plane generally perpendicular to the geometric plane established by and between the longitudinal axes of the respective end housings, a back-up roll extending between said housings behind each of said working rolls, a back-up roll chock at each end of each of the back-up rolls and providing rotary bearing support for the respective ends of the back-up rolls, chock-support means including a chock guide within and in the elongate direction of each of said housings for accommodating displacement in said direction for at least one of said back-up rolls, loading means at each end housing for urging the associated chocks toward each other to force the back-up rolls against the working rolls to load the working rolls, and separate load-transfer mechanisms reacting between associated chocks at each end housing, each load-transfer mechanism comprising hydraulic piston-cylinder means providing spreading-force application to the associated back-up roll chocks, an independently operative hydraulic control system including a control valve connected for exclusive service of the piston-cylinder means of each load-transfer mechanism, first and second gap-sensor means positioned to sense working-roll gap at the respective ends of said pass, and means including a microprocessor with separate connections to said first and second gap-sensor means and with hydraulic-control connections to said load-transfer mechanisms for automatically controlling the relative chock-spreading actions of said respective load-transfer mechanisms.

27. A rolling mill comprising two spaced parallel upstanding side housings, two vertically spaced horizontal working rolls establishing a pass from an entry to an exit for through-travel of material to be rolled between said side housings, a roll-mounting chock for rotary support of each end of each of said working rolls, chock-support means including a vertical chock guide in each of said side housings for accommodating at each side housing vertical displacement of at least one of the chocks, prestress-loading means at each side housing for urging the associated chocks toward each other to load the working rolls, and load-transfer mechanisms associated with and reacting in opposition to said prestress-loading means on both the entry side and the exit side of each of said side housings, each load-transfer mechanism comprising hydraulic piston-cylinder means providing spreading-force application to offset the prestress loading of the associated roll chocks, an independently operative hydraulic control system including a control valve connected for exclusive service of the piston-cylinder means of each load-transfer mechanism, and means including a microprocessor with separate pressure-sensing and hydraulic-control connections to all said load-transfer mechanisms for automatically controlling the relative spreading-force actions of said respective load-transfer mechanisms.

28. A rolling mill comprising two spaced parallel upstanding side housings, two vertically spaced horizontal working rolls establishing a pass from an entry to an exit for through-travel of material to be rolled between said side housings, a roll-mounting chock for rotary support of each end of each of said working rolls, chock-support means including a vertical chock guide in each of said side housings for accommodating at each side housing vertical displacement of at least one of the chocks, prestress-loading means at each side housing for urging the associated chocks toward each other to load the working rolls, and load-transfer mechanisms associated with and reacting in opposition to said prestress-loading means on both the entry side and the exit side of each of said side housings, each load-transfer mechanism comprising hydraulic piston-cylinder means providing spreading-force application to offset the prestress loading of the associated roll chocks, an independently operative hydraulic control system including a control valve connected for exclusive service of the piston-cylinder means of each load-transfer mechanism, and means including a microprocessor with separate piston-position sensing and hydraulic-control connections to all said load-transfer mechanisms for automatically controlling the relative spreading-force actions of said respective load-transfer mechanisms.

29. A rolling mill comprising two spaced parallel upstanding side housings, two vertically spaced horizontal working rolls establishing a pass from an entry to an exit for through-travel of material to be rolled between said side housings, a roll-mounting chock for rotary support of each end of each of said working rolls, chock-support means including a vertical chock guide in each of said side housings for accommodating at each side housing vertical displacement of at least one of the chocks, prestress-loading means at each side housing for urging the associated chocks toward each other to load the working rolls, and load-transfer mechanisms associated with and reacting in opposition to said prestress-loading means on both the entry side and the exit side of each of said side housings, each load-transfer mechanism comprising hydraulic piston-cylinder means providing spreading-force application to offset the prestress loading of the associated roll chocks, an independently operative hydraulic control system including a control valve connected for exclusive service of the piston-cylinder means of each load-transfer mechanism, first and second gap-sensor means positioned to sense working-roll gap at the respective ends of said pass, and means including a microprocessor with separate connections to said first and second gap-sensor means and with hydraulic-control connections to all said load-transfer mechanisms for automatically controlling the relative spreading-force actions of said respective load-transfer mechanisms.

30. The rolling mill of claim 27, in which a back-up roll is vertically behind each of said working rolls, and in which a chock for rotary support of each end of each back-up roll is guided by the guide in the associated side housing, said prestress-loading means and said load-transfer mechanisms being operative on said working rolls via the respective back-up roll chocks.

31. The rolling mill of claim 28, in which a back-up roll is vertically behind each of said working rolls, and in which a chock for rotary support of each end of each back-up roll is guided by the guide in the associated side housing, said prestress-loading means and said load-transfer mechanisms being operative on said working rolls via the respective back-up roll chocks.

32. The rolling mill of claim 29, in which a back-up roll is vertically behind each of said working rolls, and in which a chock for rotary support of each end of each back-up roll is guided by the guide in the associated side housing, said prestress-loading means and said load-transfer mechanisms being operative on said working rolls via the respective back-up roll chocks.

33. A rolling mill comprising two spaced parallel upstanding side housings, two vertically spaced horizontal working rolls establishing a pass from an entry to an exit for through-travel of material to be rolled between said side housings, a back-up roll vertically behind each of said working rolls, a back-up roll chock at each end of each of the back-up rolls and providing rotary support for the respective ends of the back-up rolls, chock-support means including a vertical chock guide in each of said side housings for accomodating at each side housing vertical displacement of at least one of the back-up rolls, means at each side housing for urging the associated chocks toward each other to force the back-up rolls against the working rolls to load the working rolls, and four load-transfer mechanisms there being one associated with and reacting between associated chocks on both the entry side and the exit side of each of said side housings, each load-transfer mechanism comprising hydraulic means providing spreading-force application to the associated back-up roll chocks, an independently operative hydraulic control system including a control valve connected for exclusive service of each load-transfer mechanism, first and second gap-sensor means positioned to sense working-roll gap at the respective ends of said pass, and means including a microprocessor with separate connections to said first and second gap-sensor means and with control connections to all said load-transfer mechanisms for automatically controlling the relative chock-spreading actions of said respective load-transfer mechanisms.

34. A rolling mill comprising two spaced parallel upstanding side housings, two vertically spaced horizontal working rolls establishing a pass from an entry to an exit for through-travel of material to be rolled between said side housings, a back-up roll vertically behind each of said working rolls, a back-up roll chock at each end of each of the back-up rolls and providing rotary support for the respective ends of the back-up rolls, chock-support means including a vertical chock guide in each of said side housings for accommodating at each side housing vertical displacement of at least one of the back-up rolls, means at each side housing for urging the associated chocks toward each other to force the back-up rolls against the working rolls to load the working rolls, and load-transfer means comprising four load-transfer mechanisms there being one associated with and reacting between associated chocks on both the entry side and the exit side of each of said side housings, each load-transfer mechanism comprising hydraulic means providing spreading-force application to the associated back-up roll chocks, an independently operative hydraulic control system including a control valve connected for exclusive service of the load-transfer means at each side housing, first and second gap-sensor means positioned to sense working-roll gap at the respective ends of said pass, and means including a microprocessor with separate connections to said first and second gap-sensor means and with control connections to all said load-transfer mechanisms for automatically controlling the relative chock-spreading actions of said respective load-transfer mechanisms.

35. A rolling mill comprising two spaced parallel elongate end housings, two spaced working rolls extending between said housings and establishing a pass from an entry side to an exit side for through-travel of material to be rolled, the direction of said pass being in a plane generally perpendicular to the geometric plane established by and between the longitudinal axes of the respective end housings, a back-up roll extending between said housings behind each of said working rolls, a back-up roll chock at each end of each of the back-up rolls and providing rotary bearing support for the respective ends of the back-up rolls, chock-support means including a chock guide within and in the elongate direction of each of said housings for accommodating displacement in said direction for at least one of said back-up rolls, means at each end housing for urging the associated chocks toward each other to force the back-up rolls against the working rolls to load the working rolls and separate load-transfer mechanisms reacting between associated chocks at each end housing, each load-transfer mechanism comprising hydraulic means providing spreading-force application to the associated back-up roll chocks, an independently operative hydraulic control system including a control valve connected for exclusive service of each load-transfer mechanism, first and second gap-sensor means positioned to sense working-roll gap at the respective ends of said pass, and means including a microprocessor with separate connections to said first and second gap-sensor means and with control connections to said load-transfer mechanisms for automatically controlling the relative chock-spreading actions of said respective load-transfer mechanisms.

36. A rolling mill comprising two spaced parallel upstanding side housings, two vertically spaced horizontal working rolls establishing a pass from an entry to an exit for through-travel of material to be rolled between said side housings, a roll-mounting chock for rotary support of each end of each of said working rolls, chock-support means including a vertical chock guide in each of said side housings for accommodating at each side housing vertical displacement of at least one of the chocks, means at each side housing for urging the associated chocks toward each other to load the working rolls, and hydraulic load-transfer mechanisms associated with and reacting in opposition to said means on both the entry side and the exit side of each of said side housings, each load-transfer mechanism comprising hydraulic means providing spreading-force application to offset the loading of the associated roll chocks, an independently operative hydraulic control system including a control valve connected for exclusive service of each load-transfer mechanism, first and second gap-sensor means positioned to sense working-roll gap at the respective ends of said pass, and means including a microprocessor with separate connections to said first and second gap-sensor means and with control connections to all said load-transfer mechanisms for automatically controlling the relative spreading-force actions of said respective load-transfer mechanisms.

37. A rolling mill comprising two spaced parallel upstanding side housings, two vertically spaced horizontal working rolls establishing a pass from an entry to an exit for through-travel of material to be rolled between said side housings, a back-up roll vertically behind each of said working rolls, a back-up roll chock at each end of each of the back-up rolls and providing rotary support for the respective ends of the back-up rolls, chock-support means including a vertical chock guide in each of said side housings for accommodating at each side housing vertical displacement of at least one of the back-up rolls, means at each side housing for urging the associated chocks toward each other to force the back-up rolls against the working rolls to load the working rolls, and four load-transfer mechanisms there being one associated with and reacting between associated chocks on both the entry side and the exit side of each of said side housings, each load-transfer mechanism comprising hydraulic means providing spreading-force application to the associated back-up roll chocks, an independently operative hydraulic control system including a control valve connected for exclusive service of each load-transfer mechanism, first and second corresponding means for sensing a predetermined working condition at the respective ends of said pass, and means including a microprocessor with separate connections to said first and second corresponding means and with control connections to all said load-transfer mechanisms for automatically controlling the relative chock-spreading actions of said respective load-transfer mechanisms.

38. A rolling mill comprising two spaced parallel upstanding side housings, two vertically spaced horizontal working rolls establishing a pass from an entry to an exit for through-travel of material to be rolled between said side housings, a back-up roll vertically behind each of said working rolls, a back-up roll chock at each end of each of the back-up rolls and providing rotary support for the respective ends of the back-up rolls, chock-support means including a vertical chock guide in each of said side housings for accommodating at each side housing vertical displacement of at least one of the back-up rolls, means at each side housing for urging the associated chocks toward each other to force the back-up rolls against the working rolls to load the working rolls, and load-transfer means comprising four load-transfer mechanisms there being one associated with and reacting between associated chocks on both the entry side and the exit side of each of said side housings, each load-transfer mechanism comprising hydraulic means providing spreading-force application to the associated back-up roll chocks, an independently operative hydraulic control system including a control valve connected for exclusive service of the load-transfer means at each side housing, first and second corresponding means for sensing a predetermined working condition at the respective ends of said pass, and means including a microprocessor with separate connections to said first and second corresponding means and with control connections to all said load-transfer mechanisms for automatically controlling the relative chock-spreading actions of said respective load-transfer mechanisms.

39. A rolling mill comprising two spaced parallel elongate end housings, two spaced working rolls extending between said housings and establishing a pass from an entry side to an exit side for through-travel of material to be rolled, the direction of said pass being in a plane generally perpendicular to the geometric plane established by and between the longitudinal axes of the respective end housings, a back-up roll extending between said housings behind each of said working rolls, a back-up roll chock at each end of each of the back-up rolls and providing rotary bearing support for the respective ends of the back-up rolls, chock-support means including a chock guide within and in the elongate direction of each of said housings for accommodating displacement in said direction for at least one of said back-up rolls, means at each end housing for urging the associated chocks toward each other to force the back-up rolls against the working rolls to load the working rolls, and separate load-transfer mechanisms reacting between associated chocks at each end housing, each load-transfer mechanism comprising hydraulic means providing spreading-force application to the associated back-up roll chocks, an independently operative hydraulic control system including a control valve connected for exclusive service of each load-transfer mechanism, first and second corresponding means for sensing a predetermined working condition at the respective ends of said pass, and means including a microprocessor with separate connections to said first and second corresponding means and with control connections to said load-transfer mechanisms for automatically controlling the relative chock-spreading actions of said respective load-transfer mechanisms.

40. A rolling mill comprising two spaced parallel upstanding side housings, two vertically spaced horizontal working rolls establishing a pass from an entry to an exit for through-travel of material to be rolled between said side housings, a roll-mounting chock for rotary support of each end of each of said working rolls, chock-support means including a vertical chock guide in each of said side housings for accommodating at each side housing vertical displacement of at least one of the chocks, means at each side housing for urging the associated chocks toward each other to load the working rolls, and hydraulic load-transfer mechanisms associated with and reacting in opposition to said means on both the entry side and the exit side of each of said side housings, each load-transfer mechanism comprising hydraulic means providing spreading-force application to offset the loading of the associated roll chocks, an independently operative hydraulic control system including a control valve connected for exclusive service of each load-transfer mechanism, first and second corresponding means for sensing a predetermined working condition at the respective ends of said pass, and means including a microprocessor with separate connections to said first and second corresponding means and with control connections to all said load-transfer mechanisms for automatically controlling the relative spreading-force actions of said respective load-transfer mechanisms.

* * * * *